US007216631B2

(12) United States Patent
Nishiwaki et al.

(10) Patent No.: US 7,216,631 B2
(45) Date of Patent: May 15, 2007

(54) FLOW DAMPER FOR COMMON RAIL FUEL INJECTION APPARATUS

(75) Inventors: Tadashi Nishiwaki, Kariya (JP); Hiroyuki Yokoya, Anjo (JP); Masayuki Nakamura, Toyota (JP)

(73) Assignee: Denso Corporation, Kariya, Aichi-pref. (JP)

( * ) Notice: Subject to any disclaimer, the term of this patent is extended or adjusted under 35 U.S.C. 154(b) by 24 days.

(21) Appl. No.: 11/261,589

(22) Filed: Oct. 31, 2005

(65) Prior Publication Data

US 2006/0090736 A1 May 4, 2006

(30) Foreign Application Priority Data

Oct. 29, 2004 (JP) ..... 2004-317277

(51) Int. Cl.
*F02M 37/04* (2006.01)

(52) U.S. Cl. ..... 123/467

(58) Field of Classification Search ..... 123/467, 123/456, 468, 469, 470
See application file for complete search history.

(56) References Cited

U.S. PATENT DOCUMENTS 3,735,777 A 5/1973 Katzer et al.
5,511,528 A 4/1996 Iwanaga et al.
6,244,253 B1 6/2001 Haeberer et al.
6,357,415 B1 3/2002 Mori
7,114,928 B2 * 10/2006 Asayama et al. ..... 417/470
2004/0094127 A1 5/2004 Watanabe
2005/0082823 A1 4/2005 Neumaier
2005/0098159 A1 5/2005 Nishiwaki

FOREIGN PATENT DOCUMENTS

DE 10254465 A1 6/2003
DE 10216280 A1 10/2003
EP 0531533 A1 3/1993
EP 1529954 A1 5/2005

* cited by examiner

*Primary Examiner*—Thomas Moulis
(74) *Attorney, Agent, or Firm*—Nixon & Vanderhye P.C.

(57) ABSTRACT

A flow damper is provided with a clearance to absorb a deformation occurring in proximate to a lower end of the valve body by the clearance on an entire outer circumference of a lower side of a large diameter portion of a piston. By the configuration in this manner, even if the slight deviation in the accuracy or the shape of the seat surface occurs a radially inward deformation of a lower portion of the valve body when the valve body is fastened to the common rail body at a large axial force, the clearance absorbs the deformation. Thus, the deformation of the valve body does not affect the piston sliding hole. Accordingly, a sliding clearance of the piston does not change, not to spoil a slide motion of the piston.

7 Claims, 16 Drawing Sheets

LARGE AXIAL FORCE

FLOW DAMPER FOR COMMON RAIL FUEL INJECTION APPARATUS

CROSS REFERENCE TO RELATED APPLICATION

This application is based upon and claims the benefit of priority of Japanese Patent Application No. 2004-317277 filed on Oct. 29, 2004, the content of which is incorporated herein by reference.

FIELD OF THE INVENTION

The present invention relates to a flow damper (safety valve) to be fastened to a common rail body of a common rail fuel injection apparatus.

BACKGROUND OF THE INVENTION

Conventional flow damper is described referring to FIG. 16.

A flow damper J1 in FIG. 16 is provided with: an approximately cylinder-shaped valve body J2 in which a fuel passage is formed; a piston J4 that is slidable in an axial direction along a piston slide hole J3 formed in the valve body J2; a spring J5 that urges the piston J4 to an upstream side of a fuel flow; and a stopper J6 that restricts a travel of the piston J4 to the upstream side.

In the piston J4 is formed an aperture path J7 that communicates an upstream side and a downstream side of the fuel passage. When any abnormal condition such as excessive fuel outflow occurs in the injector, a downstream flow amount increases to increase a pressure difference before and after the aperture path J7, and the piston J4 moves to the downstream side (injector side) to seat a valve portion J8 of the piston J4 on a valve seat J9 of the valve body J2. In this manner, the flow damper J1 stops the outflow of the high-pressure fuel when any malfunction occurs accidentally (refer to U.S. Pat. No. 6,357,415-B and its counterpart JP-3521811-B, for example).

The conventional flow damper J1 has the following issues.

(1) The valve body J2 is one to be fastened to a common rail body J10. The common rail body J10 accumulates high-pressure fuel, so that intimate contact surfaces of the valve body J2 and the common rail body J10 must be highly oil tight seal surfaces, and the valve body J2 is fastened to the common rail body J10 at a large axial force.

The valve body J2 is fastened to the common rail body J10 at a high strength, so that even a slight deviation in accuracy or shape of a seat surface can distort the valve body J2 in a rotational side at the large axial force.

The valve body J2 supports the piston J4 therein in a slidable state, therefore, if the valve body J2 is distorted by the above-described cause to deform the piston slide hole J3 radially inward, a slide clearance between the valve body J2 and the piston J4 decreases to spoil a slide motion of the piston J4.

In addition, the intimate contact surfaces of the valve body J2 and the common rail body J10 (or the stopper J6) require high work accuracy such as a high flatness, which is a cause of a cost increase.

(2) A female screw (a hole for inserting the valve body J2 thereinto) J11 of the common rail body J10 may have strain such as deformation by any kind of cause. Correspondingly, as shown in FIG. 16, a male screw J12 at a side of the valve body J2 is provided on an outer circumference of a direct slide range J2 in which the valve body J2 and the piston J4 are in direct slide contact with each other.

Thus, when the valve body J2 is fastened to the common rail body J10 at the large axial force, the strain that occurs in the female screw J11 of the common rail body J10 is transmitted via a screw-fastening portion to the valve body J2. As a result, the valve body J2 is distorted and the piston slide hole J3 is distorted, too.

In this manner, the distortion of the piston slide hole J3 spoils the slide motion of the piston J4.

SUMMARY OF THE INVENTION

The present invention is achieved in view of the above-described issues, and has an object to provide a flow damper in which a piston slide motion is not spoiled even if a valve body is fastened to a common rail body at a large axial force.

The flow damper has: a valve body to be fastened to a port of a common rail body of a common rail fuel injection apparatus, the valve body having an approximately cylinder-shaped piston hole in one end portion thereof so that the piston hole is coaxially aligned to the valve body to open to the port and to provide a cylindrical wall between an outer circumference of the valve body and an inner circumference of the piston hole; a piston that slides in the piston hole to start or block a fuel flow through the valve body; and a piston operation securing means that secures a slide motion of the piston against a force for the common rail to press the valve body to occur a distortion in the cylindrical wall when the valve body is fastened to the port of the common rail body.

BRIEF DESCRIPTION OF THE DRAWINGS

Other objects, features and advantages of the present invention will be appreciated, as well as methods of operation and the function of the related parts, from a study of the following detailed description, the appended claims, and the drawings, all of which form a part of this application. In the drawings:

DESCRIPTION OF THE PREFERRED EMBODIMENTS

First Embodiment

Figure 1:
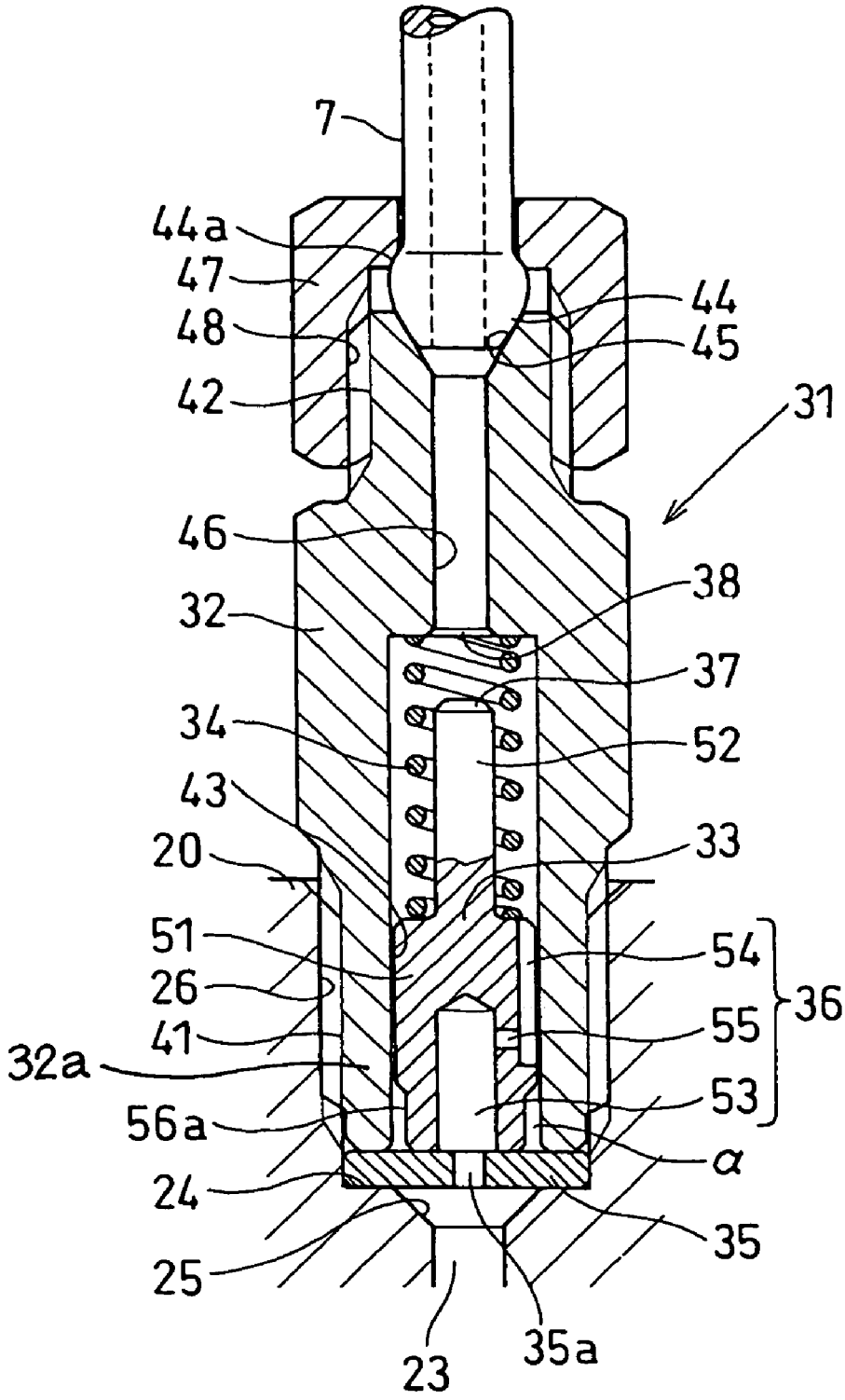
FIG. 1 is a cross-sectional view showing a flow damper according to a first embodiment of the present invention.
Figure 2:
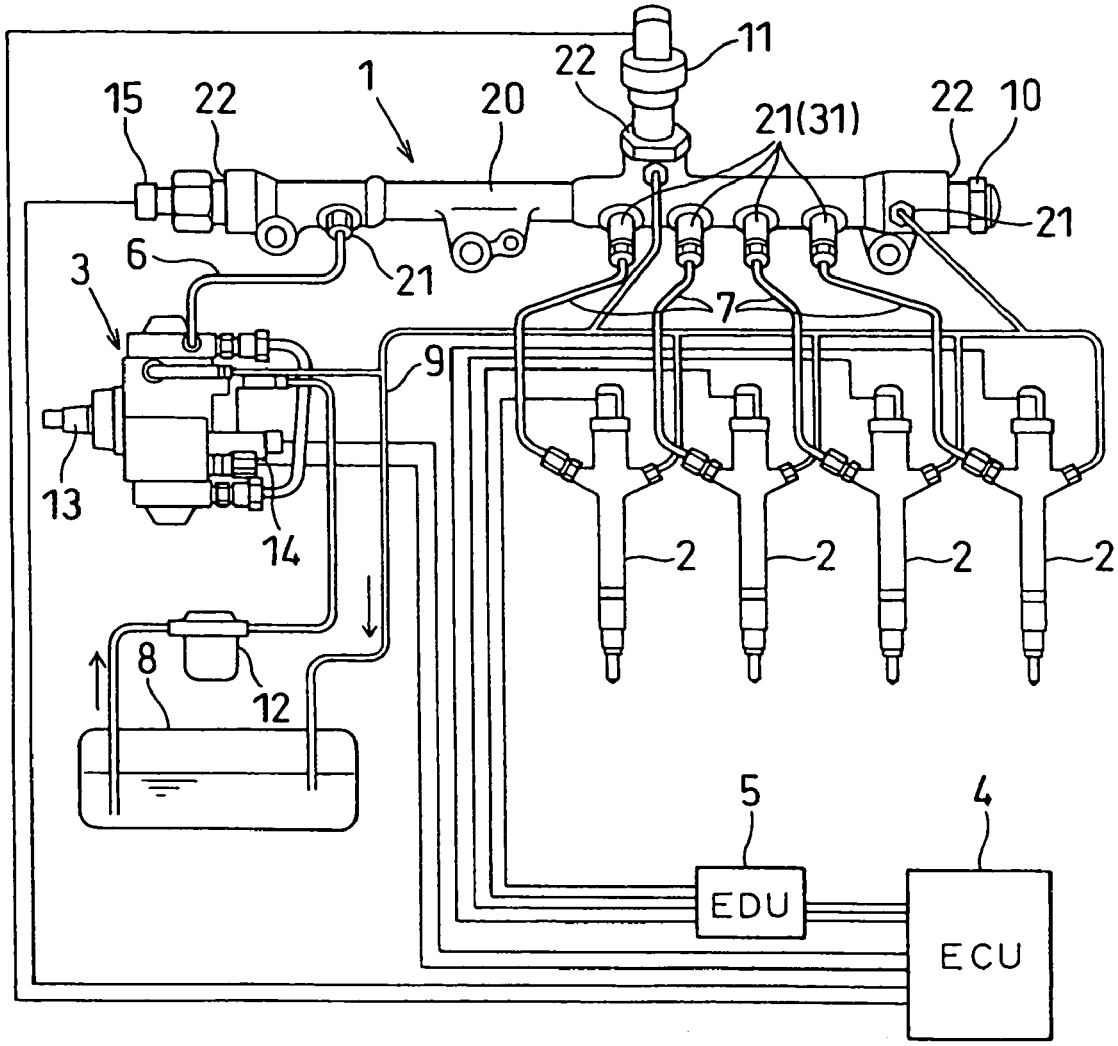
FIG. 2 is a system construction diagram showing a common rail fuel injection apparatus according to the first embodiment.

In a first embodiment, a system construction of a common rail fuel injection apparatus is described referring to FIG. 2, then a flow damper is described referring to FIG. 1.

The common rail fuel injection apparatus shown in FIG. 2 is a system for performing fuel injections in respective cylinders of an engine (for example, a diesel engine: not shown). The common rail fuel injection apparatus is composed of: a common rail 1; an injector 2; a supply pump 3; an ECU (engine control unit) 4; an EDU (driving unit); and so on.

The common rail 1 is an accumulation container to accumulate high-pressure fuel to be supplied to the injector 1 therein. The common rail 1 is connected via a high-pressure pump pipe 6 to an outflow port of the supply pump 3 to pressure-feed the high-pressure pump so as to accumulate a common rail pressure corresponding to a fuel injection pressure therein. Further, the common rail 1 is connected to a plurality of injector pipes 7 to supply the high-pressure fuel to the respective cylinders.

A flow damper 31 is provided at a connection portion of the common rail 1 and the injector pipe 7. A detailed description of the flow damper 31 is given later.

In a relief pipe 9 to return the fuel from the common rail 1 to a fuel tank 8 is installed a pressure limiter 10. The pressure limiter 10 is a pressure safety valve that opens when a fuel injection pressure in the common rail 1 exceeds a limit set value to limit the fuel injection pressure in the common rail 1 within the limit set value.

Further, on the common rail 1 is installed a pressure reduction valve 11. The pressure reduction valve 11 opens in accordance with a valve open signal applied by the ECU 4 to reduce the common rail pressure via the relief pipe 9 rapidly. In this manner, by installing the pressure reduction valve 11 on the common rail 1, the ECU 4 can perform a rapid reduction control of the common rail pressure to a pressure in accordance with a vehicle driving state. Some common rail 11 is not provided with the pressure reduction valve 11.

The injector 2 is installed in every cylinder of the engine to supply and inject the fuel in the cylinder. The injectors 2 are connected to downstream ends of a plurality of injector pipes 7 that branch out from the common rail 1. In the injector 2 are installed a fuel injection nozzle that supplies and injects the high-pressure fuel accumulated in the common rail 1, an electromagnetic valve that performs a lift control of a needle installed in the fuel injection nozzle, and so on.

Leakage fuel from the injector 2 returns via the relief pipe 9 to the fuel tank 8, too.

The supply pump 3 is a high-pressure fuel pump to pressure-feed the high-pressure fuel to the common rail 1. On the supply pump 3 is installed a feed pump that sucks the fuel in the fuel tank 8 via a filter 12 to the supply pump 3. The supply pump 3 compresses the fuel sucked by the feed pump to high-pressure, then pressure-feeds the fuel to the common rail 1. The feed pump and the supply pump 3 are driven by an identical camshaft 13. The camshaft 13 is rotatably driven by the engine.

On the supply pump 3, a SCV 14 (suction control valve) is installed on a fuel passage to lead the fuel into a pressurization chamber to pressurize the fuel to the high-pressure, to adjust an opening degree of the fuel passage. The SCV 14 adjusts a fuel suction amount sucked into the pressurization chamber and changes a fuel discharge amount to be pressure-feed to the common rail 1, by being driven by a pump driving signal from the ECU 4. That is, the ECU 14 adjusts the common rail pressure to a pressure in accordance with a vehicle driving state by controlling the SCV 14.

The ECU 4 is provided with: a CPU that performs a control process and a calculation process; a storage device (a memory device such as a ROM, a standby RAM, an EEPROM and RAM) to store respective programs and data; and a microcomputer with conventional construction including functions such as an input circuit, an output circuit, and a power supply circuit. Then, the ECU 4 performs respective calculation processes in accordance with sensor signals (engine parameters: signals in accordance with driver's driving state, engine driving state, and so on) that are read in the ECU 4.

To the ECU 4 are connected, as detection means to detect the driving state and the like, sensors and the like such as an acceleration sensor to detect an opening degree of an accelerator, a rotational frequency sensor to detect a number of rotation of the engine, a coolant temperature sensor to detect a temperature of a coolant of the engine, in addition to a common rail pressure sensor 15

A specific example of a calculation in the ECU 4 is shown. The ECU 4 performs controls of an injector control system, which performs a drive control of the injector 2, and of a common rail pressure control system, which performs a drive control of the SCV 14.

In each fuel injection, the injector control system calculates an injection pattern, a target injection amount and an injection start timing in accordance with the programs stored in the ROM and the sensor signals (engine parameters) read in the RAM, then calculates an injector valve-open signal.

The common rail pressure control system calculates a target common rail pressure in accordance with the programs stored in the ROM and the sensor signals (engine parameters) read in the RAM, then calculates a SCV driving signal to equalize an actual common rail pressure, which is calculated by the common rail pressure sensor 15, to the target common rail pressure.

The EDU 5 is provided with: an injector drive circuit that applies a valve-open driving current to the electromagnetic valve of the injector 2 in accordance with a injector valve-open signal applied by the ECU 4; and a pump drive circuit that applies a drive current value to the SCV 14 in accordance with a SCV drive signal (duty signal) applied by the ECU 4. The EDU 5 may be installed in a casing together with the ECU 4.

The common rail 1 is a common rail body 20 having a pipe-shape to accumulate ultra high-pressure fuel therein and provided with a pipe connection means 21 to connect the high-pressure pump pipe 6, the relief pipe 9, the injector pipes 7 thereto. In addition to the pipe connection means 21, the common rail body 20 is provide with a functional component connection portions 22 to install the pressure limiter 10, the pressure reduction valve 11, the common rail pressure sensor 15, and so on.

As shown in FIG. 2, the common rail body 20 may be one formed by forging and on which respective holes and flat surface portions (after-mentioned intra common rail passage, inside and outside communication holes 23, a first flat surface 24, and so on) are worked after the forging. As an alternative of the one shown in FIG. 2, the common rail body 20 may be constructed of a low-cost pipe material and on which a number of the pipe connection means 21 in an axial direction of the pipe material, to decrease a manufacturing cost.

The common rail body 20 is made of hard metal such as steel. The common rail body 20 is provided therein with an intra common rail passage (high-pressure accumulation chamber, not shown) along a longitudinal direction of the common rail body 20.

Further, on a side of the common rail body 20 are formed a plurality of the inside and outside communication holes 23 to communicate its outer circumference and the intra common rail passage (refer to FIG. 1). The inside and outside communication holes 23 are to be communicated with the high-pressure pump pipe 6, the relief pipe 9, the injector pie 7, and so on. The inside and outside communication holes 23 are bored at adequate intervals in the axial direction of the common rail body 20. An outer side of each inside and outside communication hole 23 opens approximately at a center of the first flat surface 24 formed on the side surface of the common rail body 20.

The outer opening (outside opening portion) of the inside and outside communication hole 23 is provided with a chamfered portion that extends radially outward, to increase an opening area of the outer opening of the inside and outside communication hole 23.

Further, on an inner face of the hole around the first flat surface 24 is formed a first female screw 26 to fasten the pipe connection means 21 (a valve body 32 in an after-mentioned flow damper 31) thereto (refer to FIG. 1). An example in which the first female screw 26 is integrally provided with the common rail body 20, however, the first female screw 26 may be a female screw part such as a nut that is fixed on (combined with) the common rail body 20 by welding and the like.

A part of the pipe connection means 21 to connect the common rail body 20 and the injector pipes 7 is provided with a flow damper 31 shown in FIG. 1.

The flow damper 31 is provided with: a valve body 32 that is to be fastened to the common rail body 20; a piston 33 that slides in the valve body 32; a spring 34 that urges the piston 33 to an upstream side of fuel flow; and a stopper 35 that restricts a travel of the piston 33 to the upstream side.

In the piston 33 is formed an aperture path 36 that communicates an upstream side and a downstream side of the fuel passage. When any abnormal condition such as excessive fuel outflow occurs in the injector 2, a downstream flow amount increases to increase a pressure difference before and after the aperture path 36, and the piston 33 moves to the downstream side (injector 2 side) to seat a valve portion 37 of the piston 33 on a valve seat 38 of the valve body 32. In this manner, the flow damper 31 stops the outflow of the high-pressure fuel when any malfunction occurs accidentally.

Respective parts of the flow damper 31 are described in detail in the following. In the following description, one side of the flow damper 31 to be connected to the common rail body 20 is referred to as "lower side", and the other side, to which the injector pipe 7 is connected, is referred to as "upper side".

The valve body 32 is made of hard metal such as steel, and has an approximately cylinder-shape in which the fuel passage is formed.

At the lower side on an outer circumference of the valve body 32 is formed a first male screw 41 to be screwed into the first female screw 26 of the common rail body 20. At the upper side on an outer circumference of the valve body 32 is formed a second male screw 42 to fix the injector pipe 7 thereon.

On a leading end surface of the first male screw 41 is formed a surface that surrounds the opening of the piston slide hole 43. An upper and lower surfaces of the stopper 35 are provided in parallel with each other. The lower surface of the stopper 35 aligns with the first surface 24 of the common rail body 20, and the upper surface of the stopper 35 aligns with the leading end surface of the first male screw 41. Thus, by screw-fastening the first male screw 41 of the valve body 32 tightly to the first female screw 26 of the common rail body 20, the first surface 24, the stopper 35 and the leading end surface of the first male screw 41 are pushed to each other to form a body seal surface (oil tight surfaces: intimate contact surfaces).

On a leading end surface of the second male screw 42 is formed a pressure reception seat surface 45 having a conically tapered shape into which a conical portion 44, which is formed on a leading end of the injector pipe 7, is inserted. On the bottom portion of the pressure reception seat surface 45 opens an upper fuel passage 46.

To the second male screw 42 is screw-fastened a second female screw 48 that is formed on an inner circumference of a pipe fastening screw member 47.

The pipe fastening screw member 47 is screwed into the second male screw 42 in a state of being engaged with a step 44*a* on the rear of the conical portion 44 of the injector pipe 7. By screw-fastening the pipe fastening screw member 47 tightly to the second male screw 42, the conical portion 44 of the injector pipe 7 is strongly pushed to the pressure reception seat surface 45 to form a pipe seal surface (oil tight surfaces: intimate contact surfaces).

Correspondingly, at a center of the valve body 32 is formed the piston slide hole 43 from a lower end to an approximately central portion to support the piston 33 slidably to provide a cylindrical wall 32*a* between an outer circumference of the valve body 32 and an inner circumference of the piston hole 43. Further, at the center at an upper portion of the valve body 32 is formed the upper fuel passage 46 that is communicated with an upper end of the piston slide hole 43. The upper fuel passage 46 and the piston slide hole 43 constitute the fuel passage.

At a boundary between the upper fuel passage 46 and the piston slide hole 43 is formed a valve seat 38 having an approximately conical shape to extend downward. The piston slide hole 43 and the upper fuel passage 46 are coaxially disposed, to locate the valve portion 37 of the piston 33 and the valve seat 38 of the valve body 32 coaxially.

The piston 33 is made of a material such as steel, aluminum and resins that is resistant to high-pressure fuel. The piston 33 is supported in the piston slide hole 43 of the valve body slidably in the axial direction. The piston 33 is provided with a lower large diameter portion 51 that directly slides on the piston slide hole 43, and an upper protruding portion 52 of which a diameter is small to form a step between the large diameter portion 51 and itself. At an upper end of the protruding portion 52 is provided with the valve portion 37 that can block the upper fuel passage 46 by seating on the valve seat 38 of the valve body 32. On the step between the large diameter portion 51 and the protruding portion 52 seats a lower end of the spring 34, so that the spring 34 urges the piston 33 downward.

In the piston 33 is formed the aperture path 36 that communicates a lower portion (a center hole 35*a* of the stopper 35) with an upper portion (an inner space of the piston slide hole 43 above the piston 33). The aperture path 36 comprises: a lower center hole 53 that is formed at the center in the lower side of the large diameter portion 51; an upper communication groove 54 that is formed on the side surface of the large diameter portion 51; and an aperture (orifice) 55 that communicates the lower center hole 53 with the upper center hole 54.

When the fuel flow amount that flows downstream in a normal operation time and the like, the urging force of the spring 34 seats the lower end of the piston 33 on the stopper 35, so that the fuel flow that has passed through the center hole 35*a* of the stopper 35 is supplied to the injector only via the aperture path 36.

When the fuel flow amount that flows downstream increases, the pressure difference before and after the aperture path 36 increases, and the piston 33 moves upward to lift the piston 33 off the stopper 35. Then, the fuel that has passed through the center hole 35*a* of the stopper 35 is supplied to the injector 2 via both the aperture path 36 and a slide clearance between the large diameter portion 51 of the piston 33 and the piston slide hole 43.

When the fuel flow amount that flows downstream increases, the pressure difference before and after the aperture path 36 further increases by a malfunction occurrence of an excessive fuel discharge into the injector 2 and the like, the pressure difference before and after the aperture path 36 further increases. Then, the piston 33 moves further upward to seat the valve portion 37 at the upper end of the protruding portion 53 on the valve seat 38 of the valve body 32 to block the upper fuel passage 46.

In this manner, the flow damper 31 stops the high-pressure fuel discharge when the fuel flow amount flowing downstream increases over a set amount by any accidental malfunction occurrence.

The stopper is made of hard metal such as steel and copper, which has a fine seal performance, and has a disc shape having the center hole 35*a* at the center of which to pass the fuel therethrough. As described above, the center hole 35*a* is the fuel passage to communicate the inside and outside communication hole 23 of the common rail body 20 and the lower center hole 53 of the piston 33. The stopper 35 is a seal member (gasket) that forms the above-described body seal surfaces being interposed between the first flat surface 24 of the common rail body 20 and the leading end surface of the first male screw 41. The stopper 35 also has a stopper function to restrict the piston 33 to move downward in the piston slide hole 43.

The spring 34 is a compression coil spring to urge the piston 33 downward. A compression load of the spring 34 determines an operation value (a set value for the flow damper 31 to interrupt the high-pressure fuel discharge) of the flow damper 31.

The valve body 32 is tightly fastened to the common rail body 20 to prevent the high-pressure fuel from leaking securely. However, in the case that the valve body 32 is tightly fastened to the common rail body 20, if a slight deviation in accuracy or a shape of the seat surface is there, the large axial force and rotational slide can deform the valve body 32. Specifically, the cylindrical wall 32*a* in the lower end portion of the valve body 32, which forms the body seal surface, is deformed.

As described above, the lower portion of the valve body 32 slidably supports the large diameter portion 51 of the piston 33 therein. The slide clearance between the large diameter portion 51 of the piston 33 and the piston slide hole 43 is small (around 10 μm to 20 μm, for example) to increase accuracy in a coaxial alignment. Thus, if the cylindrical wall 32*a* in the lower end portion of the valve body 32 deforms radially inward, the slide clearance decreases to spoil the slide motion of the piston 33.

Thus, the first embodiments provides a clearance α between the valve body 32 and the piston 33 to absorb a distortion (deformation) that occurs when the valve body 32 is fastened to the common rail body 20.

Specifically, in the first embodiment, a total outer circumference of the lower side of the large diameter portion 51 of the piston 33 is provided with a clearance (cut portion) 56*a* as shown in FIG. 1 to provide the clearance α to absorb the deformation of the cylindrical wall 32*a* of the valve body 32 in proximity to the lower end thereof. A size of the clearance equals clearances α in the after-mentioned embodiments. Alternatively, the size of the clearance capable of absorbing the deformation occurring in the valve body 32 is acceptable. The size varies in accordance with a kind of the material forming the valve body 32, a fastening torque, and so on. For example, the size If the clearance in the present embodiment is set as: approximately 5 mm to 10 mm in the axial direction from the lower end of the large diameter portion 51; and approximately 0.1 mm to 1.0 mm of width in the radial direction.

By providing the flow damper 31 as in the first embodiment, even if a slight deviation in accuracy or a shape of the seat surface occurs a radially inward deformation of the cylindrical wall 32*a* of the valve body 32 in proximity to a lower end thereof when the valve body 32 is fastened to the common rail body 20 at a large axial force, the clearance α between the valve body 32 and the piston 33 absorbs the deformation. Thus, the deformation of the valve body 32 does not affect the slide motion of the piston 33. That is, to fasten the valve body 32 to the common rail body 20 at the large axial force does not spoil the slide motion of the piston 33.

Further, the clearance α between the valve body 32 and the piston 33 absorbs the deformation of the valve body 32 occurred by the fastening at the large axial force. Thus, as in the first embodiment, it is possible to limit working accuracies of the body seal surfaces (intimate contact surfaces) of the valve body 32 and the stopper 35 for cost decrease.

Second Embodiment

Figure 3:
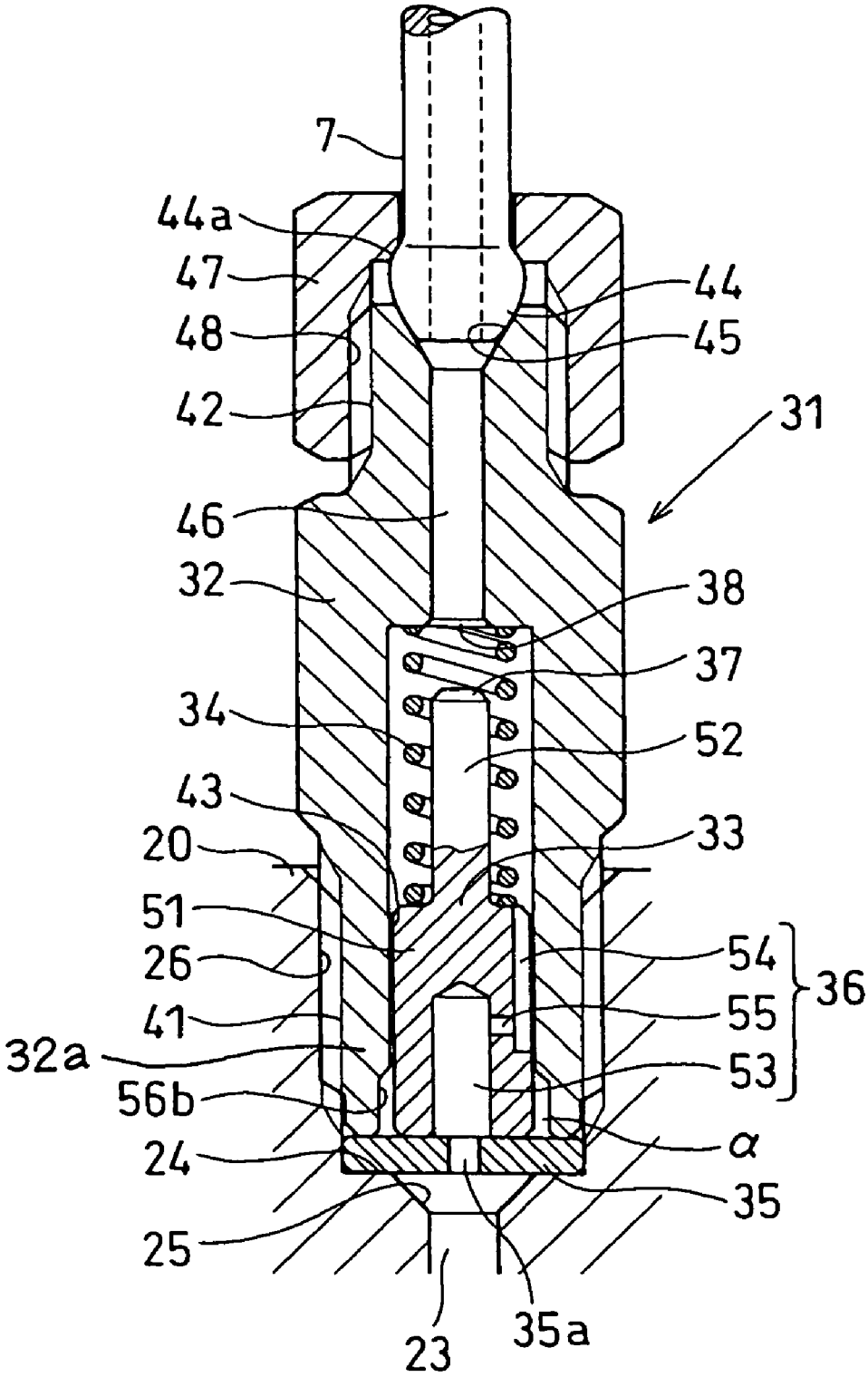
FIG. 3 is a cross-sectional view showing a flow damper according to a second embodiment of the present invention.

A second embodiment is described referring to a cross-sectional view of a flow damper 31 shown in FIG. 3. In the following embodiments, the same reference numerals as in the above-described first embodiments denote components having the same function as in the first embodiment.

In the second embodiment, as in the first embodiment, a clearance (cut portion) 25*b* is provided over an inner circumference to provide a clearance α to absorb the deformation of the cylindrical wall 32*a* the valve body 32 in the proximity of the lower end thereof.

Third Embodiment

Figure 4:
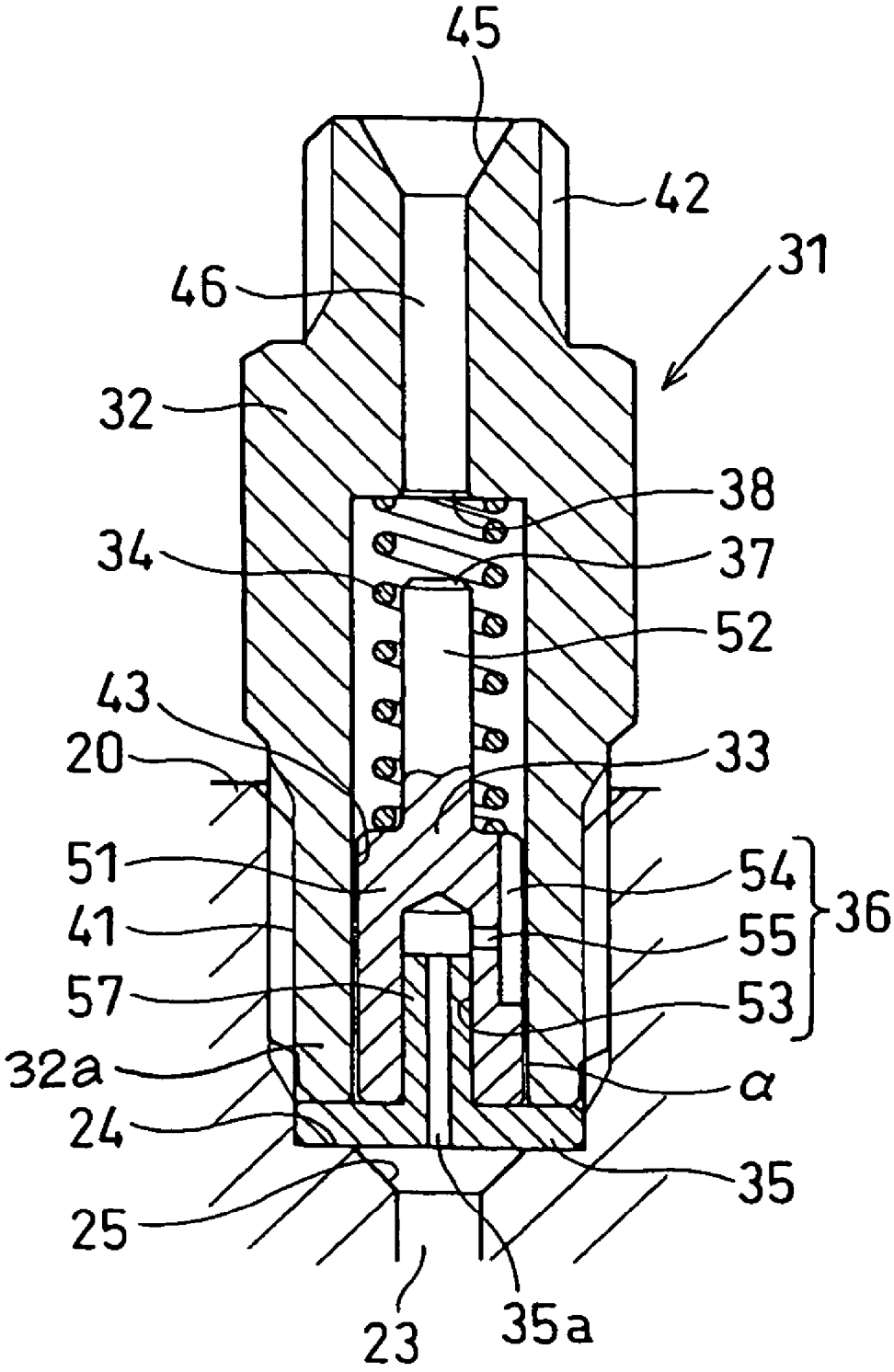
FIG. 4 is a cross-sectional view showing a flow damper according to a third embodiment of the present invention.

A third embodiment is described referring to a cross-sectional view of a flow damper 31 shown in FIG. 4.

In the third embodiment, an outer diameter size of the large diameter portion 51 of the piston 33 is smaller than an inner diameter size of the piston sliding hole 43 to provide a clearance α between the large diameter portion 51 and the piston 33 to absorb the deformation of the cylindrical wall 32*a* of the valve body 32 in the proximity of the lower end thereof.

When the outer diameter size of the large diameter portion 51 of the piston 33 is smaller than the inner diameter size of the piston sliding hole 43 as in the third embodiment, an axial center of the large diameter portion 51 of the piston 33 does not always align with that the piston sliding hole 43. Then, an axial center of the protruding portion 52 of the piston 33 does not align with that of the upper fuel passage 46 of the valve body 32. That is, a coaxial alignment of the valve seat 38 and the valve body 37 is spoiled.

In the third embodiment, an upper surface of the stopper 35 is provided with a sliding guide 57 for the piston 33. Thus, the axial center of the large diameter portion 51 of the piston 33 aligns with that of the piston sliding hole 43, to secure the coaxial alignment of the valve seat 38 and the valve portion 37. The sliding guide 57 is a support member that slidably supports an inner surface of the lower center hole 53 of the piston 33 in the axial direction, and a fuel passage is provided at the center of the sliding guide 57.

Fourth Embodiment

Figure 5:
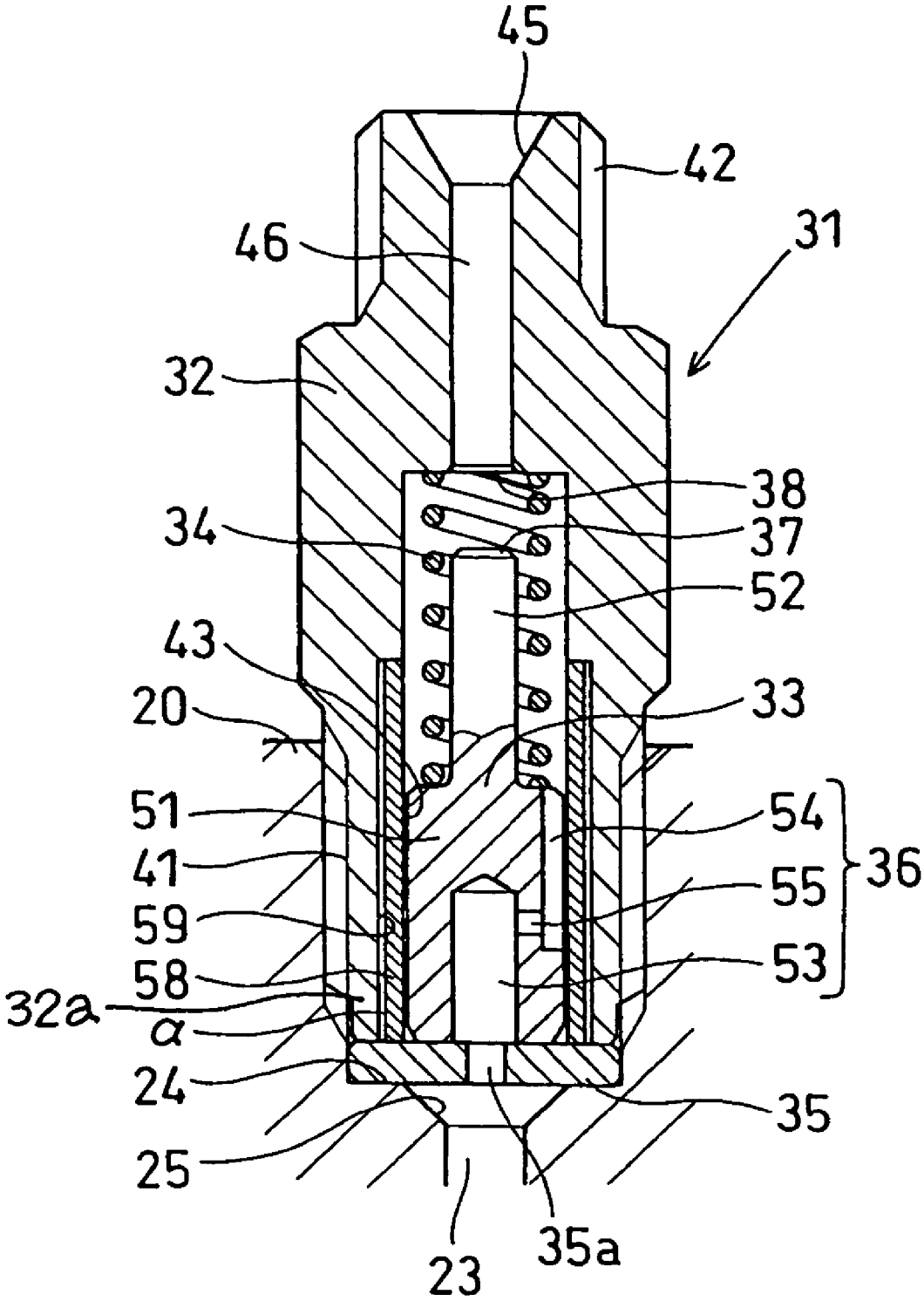
FIG. 5 is a cross-sectional view showing a flow damper according to a fourth embodiment of the present invention.

A fourth embodiment is described referring to a cross-sectional view of a flow damper 31 shown in FIG. 5.

In the fourth embodiment, a collar 58 (corresponding to an additional member), which slidably supports the piston 33, is disposed between the valve body 32 and the piston 33. Thus, a clearance α is provided between the valve body 32 and the collar 58 to absorb a deformation occurring in the valve body 32 when the valve body 32 is fastened to the common rail body 20.

Specifically, the collar 58 is a cylindrical body that slidably supports the large diameter portion 51 of the piston 33, and made of hard metal such as steel, etc. In the valve body 32 is formed a collar insertion hole 59 in which the collar 58 is inserted. An inner circumference of the collar insertion hole 59 and an outer circumference of the collar 58 provide the clearance α therebetween to absorb the deformation occurring in the valve body 32 when the valve body 32 is fastened to the common rail body 20.

By providing the flow damper 31 as in the first embodiment, even if a slight deviation in accuracy or a shape of the seat surface deforms the valve body 32 when the valve body 32 is fastened to the common rail body 20 at a large axial force, the clearance α between the valve body 32 and the collar 58 absorbs the deformation. Thus, the deformation of the valve body 32 does not affect the piston sliding hole 43 provided on an inner circumference of the collar 58. That is, to fasten the valve body 32 to the common rail body 20 at the large axial force does not spoil the slide motion of the piston 33.

Further, the clearance α between the valve body 32 and the collar 58 absorbs the deformation of the valve body 32 occurred by the fastening at the large axial force. Thus, as in the first embodiment, it is possible to limit working accuracies of the body seal surfaces (intimate contact surfaces) of the valve body 32 and the stopper 35 for cost decrease.

Fifth Embodiment

Figure 6:
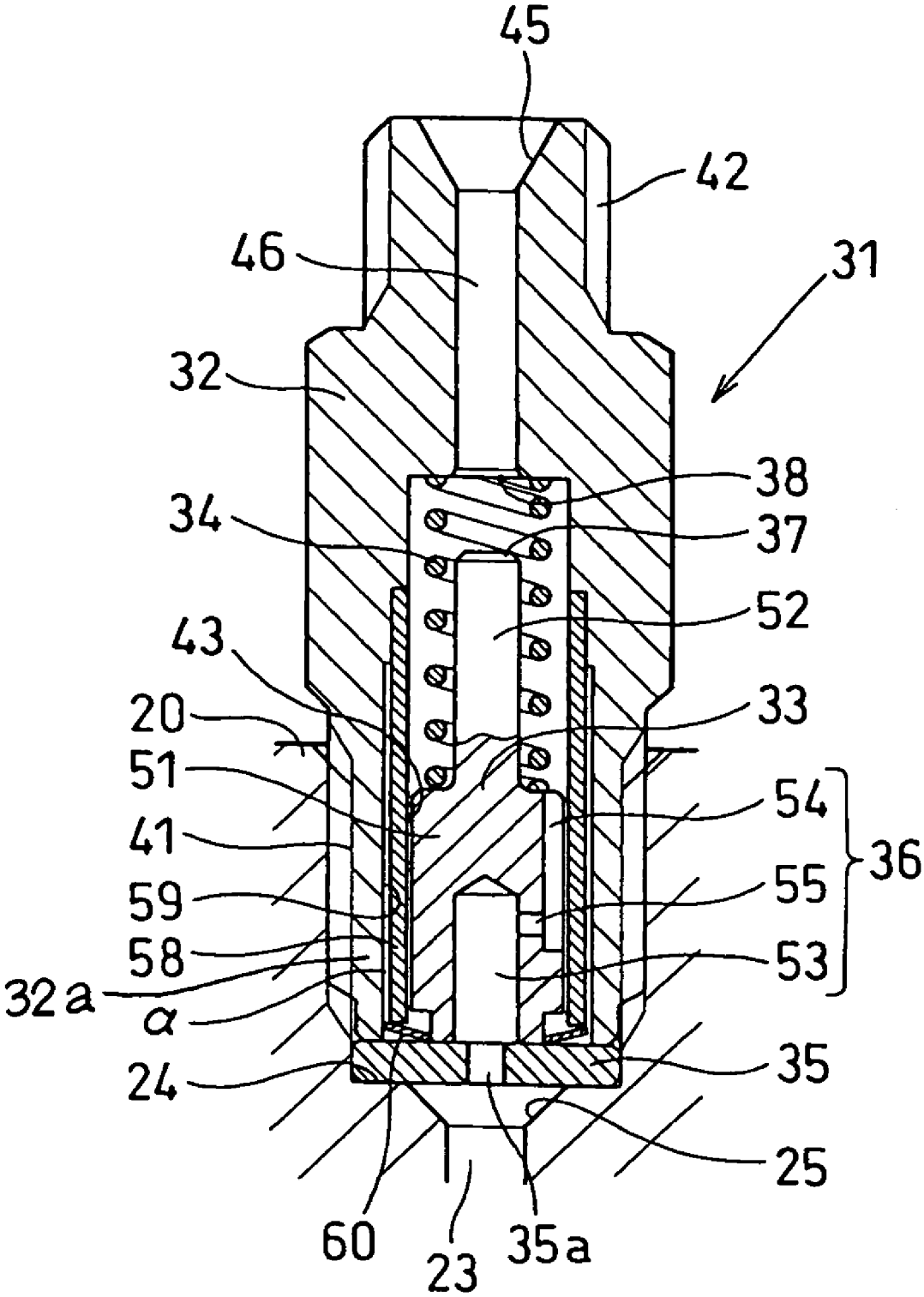
FIG. 6 is a cross-sectional view showing a flow damper according to a fifth embodiment of the present invention.

A fifth embodiment is described referring to a cross-sectional view of a flow damper 31 shown in FIG. 6.

In the fifth embodiment, an elastic body 60 is disposed between the collar 58 and the stopper 35 to get rid of a lash of the collar 58. In FIG. 6 is shown a conical spring as an example of the elastic body 60, however, other kinds of the elastic body such as a wave washer and ring rubber may be used.

Sixth Embodiment

Figure 7:
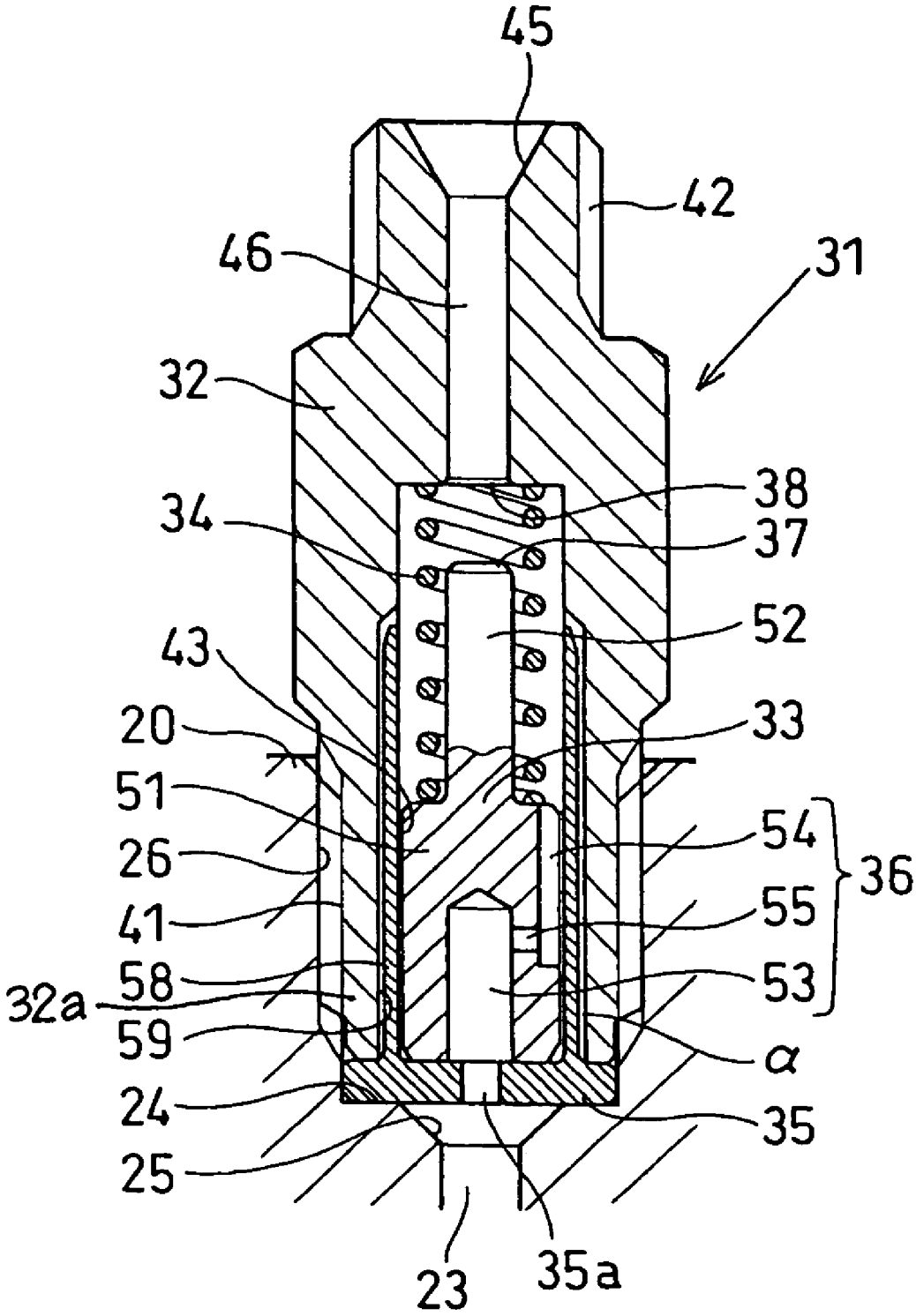
FIG. 7 is a cross-sectional view showing a flow damper according to a sixth embodiment of the present invention.

A sixth embodiment is described referring to a cross-sectional view of a flow damper 31 shown in FIG. 7.

In the sixth embodiment, the collar 58 and the stopper 35 are integrally provided, so as to decrease the number of parts, to get rid of a lash of the collar 58, and to improve a coaxial alignment of a piston 33 and a valve body 32 (that is, a coaxial alignment of a valve seat 38 and a valve portion 37.

Seventh Embodiment

Figure 8:
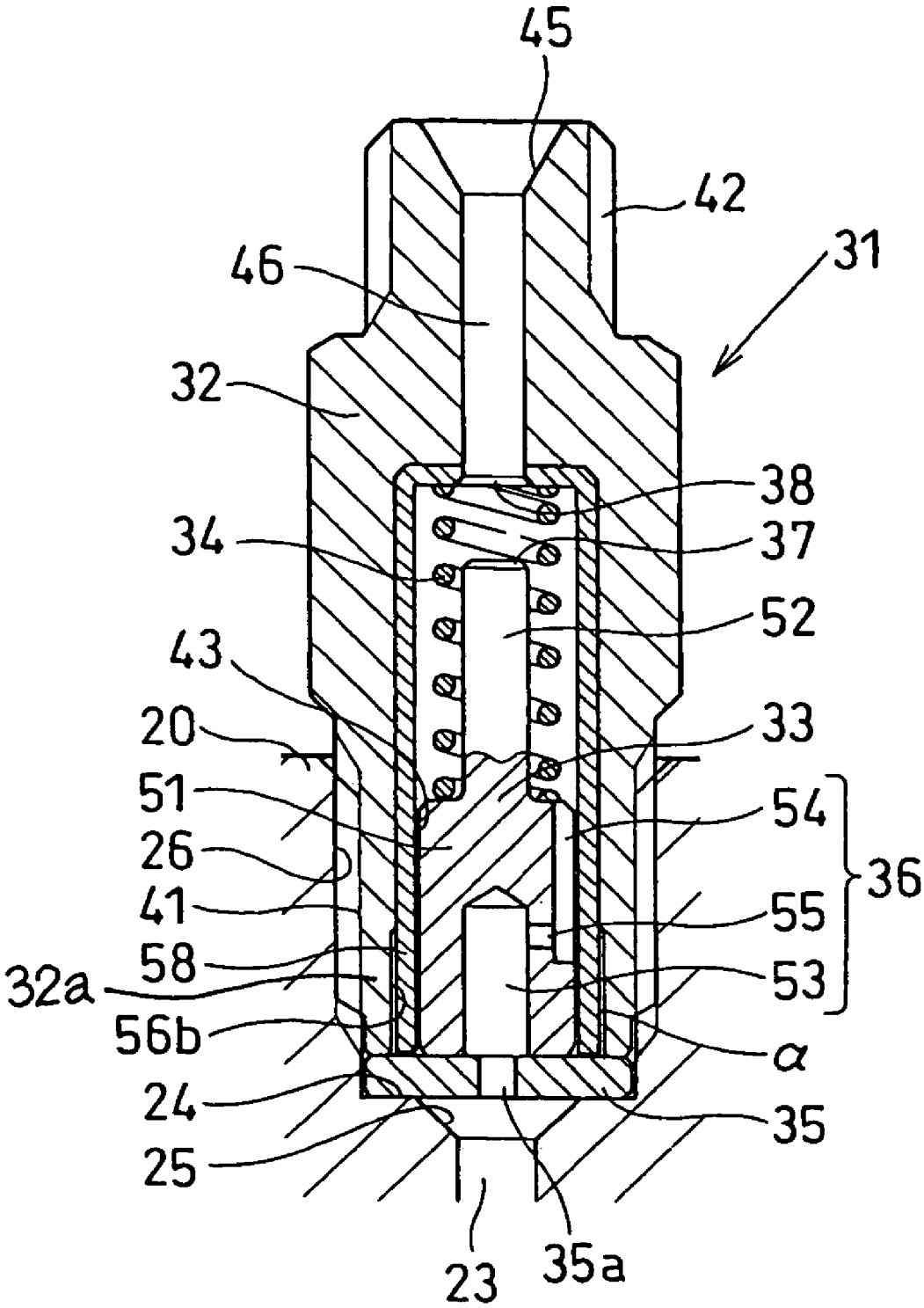
FIG. 8 is a cross-sectional view showing a flow damper according to a seventh embodiment of the present invention.

A seventh embodiment is described referring to a cross-sectional view of a flow damper 31 shown in FIG. 8.

A collar 58 in the seventh embodiment is provided with not only a piston sliding hole 43 but also a valve seat 38 on which a valve portion 37 at the leading end of the protruding portion 52 of the piston 33 seats. By providing the collar 58 in this manner, it is possible to improve a coaxial alignment of a valve seat 38 and a valve portion 37.

Eighth Embodiment

Figure 9:
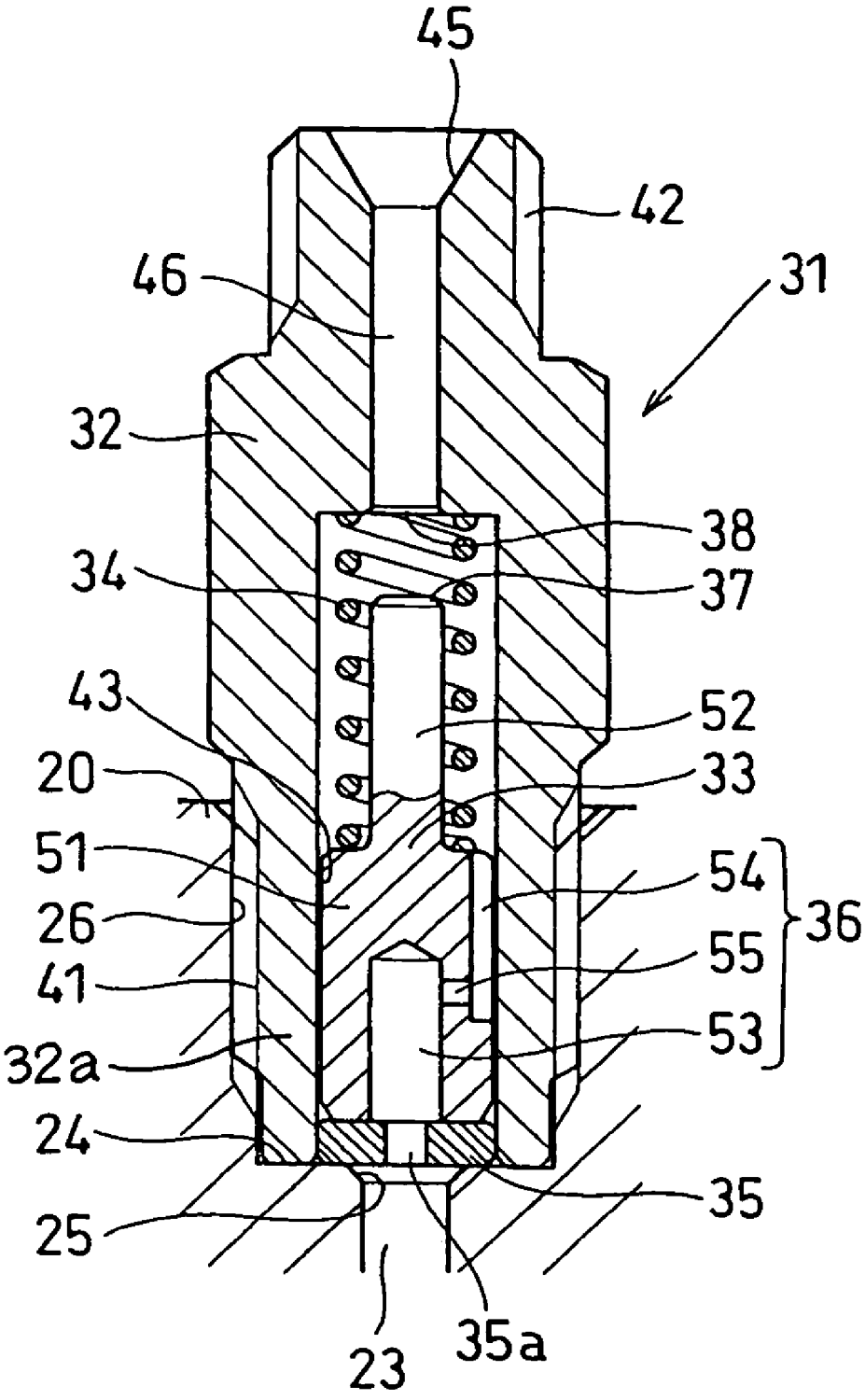
FIG. 9 is a cross-sectional view showing a flow damper according to an eighth embodiment of the present invention.

An eighth embodiment is described referring to a cross-sectional view of a flow damper 31 shown in FIG. 9.

In the eighth embodiment, a restriction member is press-fitted into a piston sliding hole 43 of the valve body 32 to prevent a deformation, which occurs in the valve body 32 when the valve body 32 is fastened to the common rail body 20, from extending radially inward in the piston sliding hole 43.

Specifically, in the eighth embodiment is shown an example in which a stopper 35 is press-fitted as the restriction member in the piston sliding hole 43. Alternatively, another restriction member other than the stopper 35 may be press-fitted to an inner circumference of the piston sliding hole 43.

In the present embodiment, a lower end face the cylindrical wall 32*a* of the valve body 32 is in an intimate contact with a first flat surface 24 of the common rail body 20 to form body seal surfaces (oil tight surfaces: intimate contact surfaces).

By the configuration as in the eighth embodiment, even when the valve body 32 is fastened to the common rail body 20 at a large axial force, the stopper 35 (restriction member), which is press-fitted to the inner circumference of the piston sliding hole 43, prevents the piston sliding hole 43 from deforming radially inward. That is, even when the valve body 32 is fastened to the common rail body 20 at the large axial force, it is possible to prevent the sliding clearance between the valve body 32 and the piston 33 from decreasing so as not to spoil a slide motion of the piston 33.

Further, the stopper 35 (restriction member) prevents the piston sliding hole 43 from being deformed radially inward by the fastening at the large axial force, so that it is possible to limit working accuracies of the intimate contact surfaces of the valve body 32 and the common rail body 20 for cost decrease.

Ninth Embodiment

Figure 10:
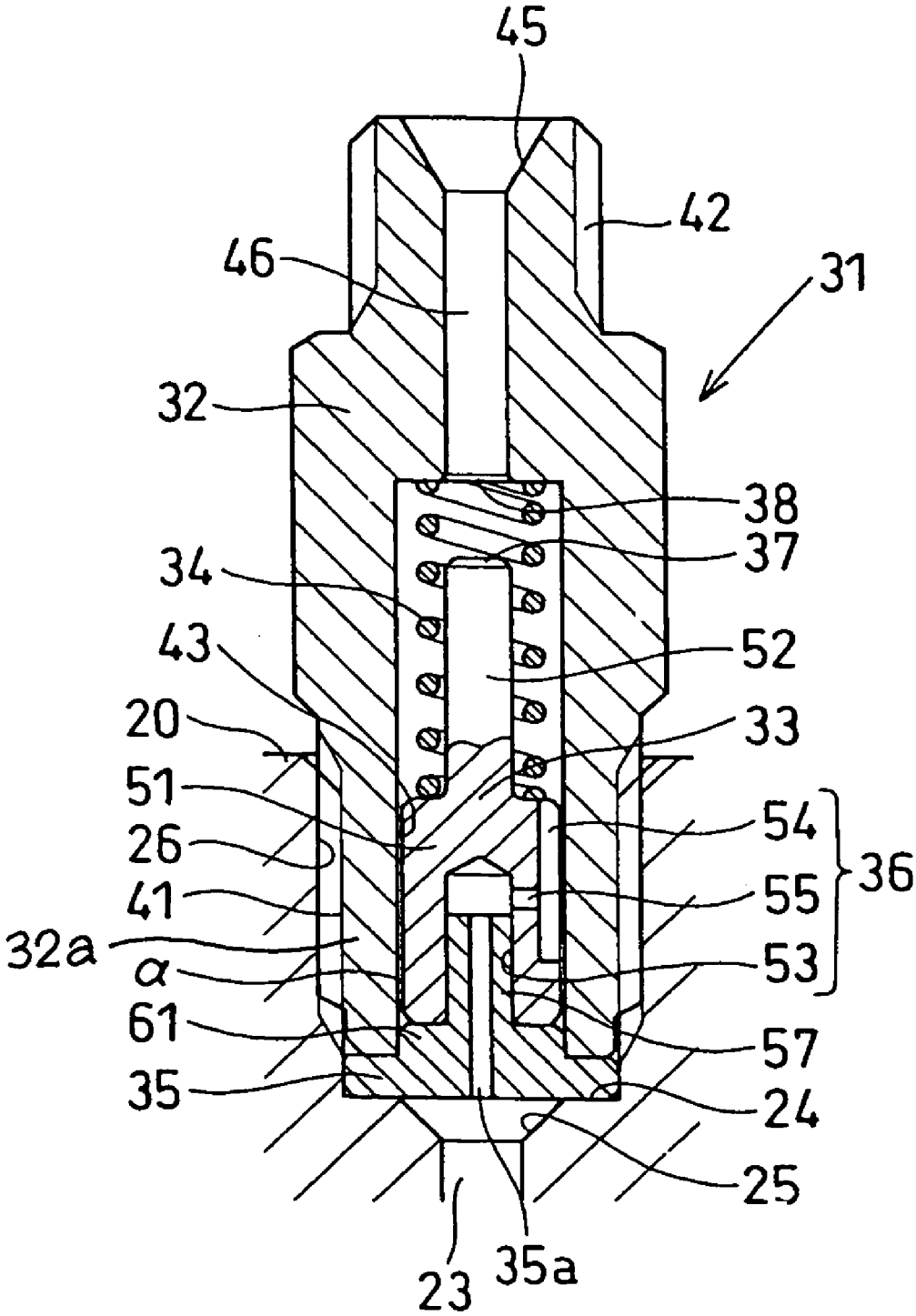
FIG. 10 is a cross-sectional view showing a flow damper according to a ninth embodiment of the present invention.

A ninth embodiment is described referring to a cross-sectional view of a flow damper 31 shown in FIG. 10.

In the ninth embodiment, the above-described stopper 35 in the third embodiment is provided on its upper surface with a press-fitting portion 61 (restriction member) that is press-fitted into an inner circumference of the piston sliding hole 43.

Tenth Embodiment

Figure 11A:
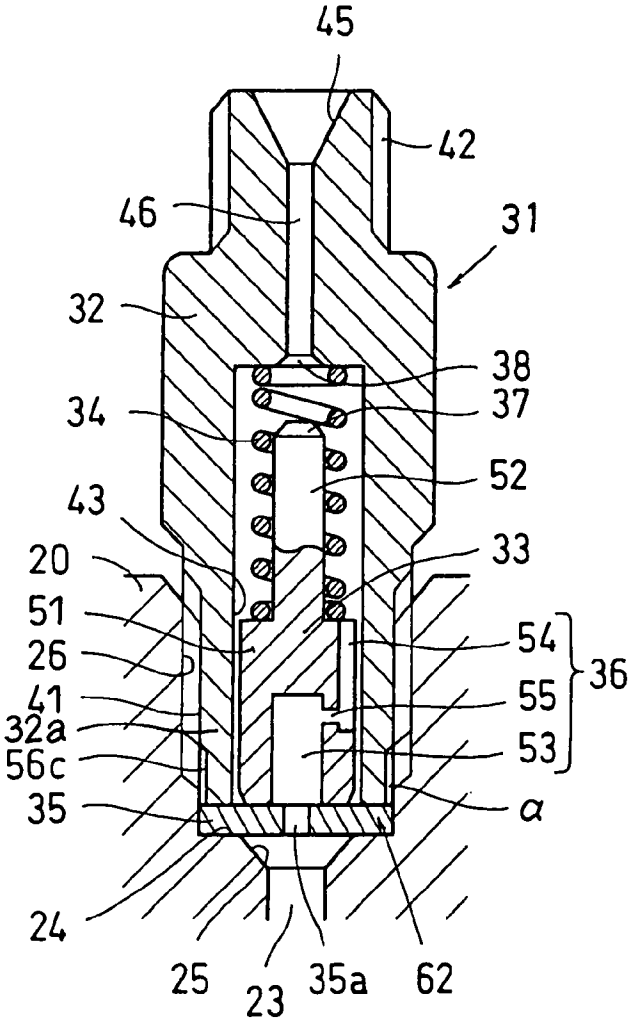
FIG. 11A is a cross-sectional view showing a flow damper according to a tenth embodiment of the present invention.
Figure 11B:
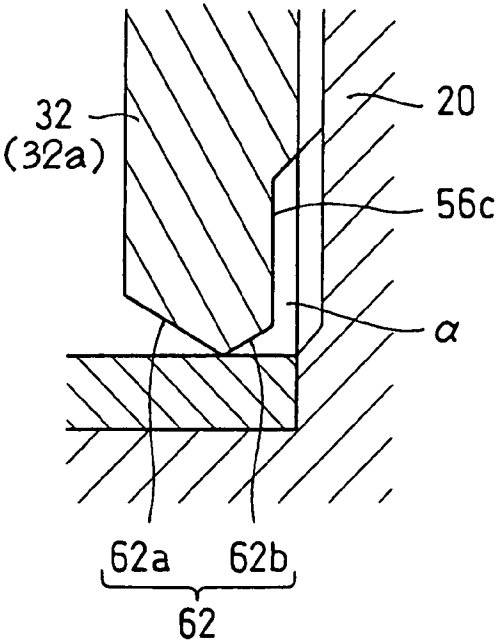
FIG. 11B is an enlarged cross-sectional view showing a leading end of a valve body of the flow damper according to the tenth embodiment.
Figure 11C:
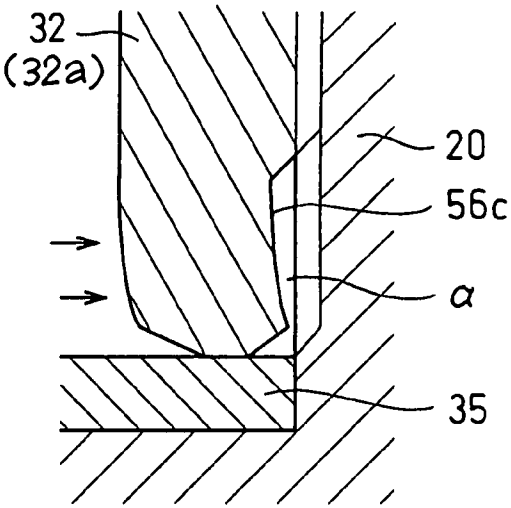
FIG. 11C is an enlarged cross-sectional view showing a deformed state of the leading end of a valve body of the flow damper according to the tenth embodiment.

An eighth embodiment is described referring to a cross-sectional view of a flow damper 31 and a enlarged view of a principal portion of a leading end of a valve body shown in FIGS. 11A to 11C.

In the tenth embodiment are provided: (1) a distortion diverting out means 62 that diverts a distortion, which occurs radially outward in the valve body 32 when the valve body 32 is fastened to the common rail body 20; and (2) a clearance α between the valve body 32 and the common rail body 20 to absorb the radially outward distortion by the distortion diverting out means 62.

Specifically, when the valve body 32 is fastened to the common rail body 20, a slight deviation in accuracy or a shape of the seat surface occurs the deformation in the cylindrical wall 32*a* of the valve body 32 in proximity to a lower end thereof.

In the tenth embodiment, as shown in FIG. 11B, a lower end surface of the cylindrical wall 32*a* of the valve body 32, which is subjected to a rotational slide under a large axial force in a fastening time of the valve body 32, is provided with tapering surfaces (inner circumferential tapering width 62*a*>Outer circumferential tapering width 62*b*) to deviate the deformation radially outward. Thus, a lower end of the cylindrical wall 32*a* is disposed radially outside of a midpoint in the thickness of the cylindrical wall 32.

Alternatively, the distortion diverting out means 62 may be provided with one tapering surface at the lower end surface of the cylindrical wall 32*a* so that the lower end of the tapering surface is disposed on a radially outer periphery of the lower end surface of the cylindrical wall 32. Further, the distortion diverting out means 62 may be provided with a rounding at the lower end surface of the cylindrical wall 32*a* so that the lower end of the rounding is disposed radially outside of a midpoint in the thickness of the cylindrical wall 32.

By providing the distortion diverting out means 62 by the tapering surfaces, when the valve body 32 is tightly screw-fastened to the common rail body 20, the cylindrical wall 32*a* of the valve body 32 in the proximity of the lower end deforms radially outward as shown in FIG. 11C.

Correspondingly, the clearance α is provided between the valve body 32 and the common rail body 20 (a hole for inserting the valve body 32) to absorb the deformation of the cylindrical wall 32*a* the valve body 32 in the proximity of the lower end that occurs radially outward by the distortion diverting out means 62.

Specifically, in the tenth embodiment, as shown in FIG. 11A, the clearance (cut portion) 56*c* is provided to extend over the outer circumference of the lower side of the valve body 32, so that the clearance α is provided to absorb the radially outward deformation of the cylindrical wall 32*a* of the valve body 32 in the proximity of the lower end thereof.

By the configuration as in the tenth embodiment, the deformation in the fastening time of the valve body 32 to the common rail body at the large axial force, occurs radially outward. Then, the deformation is absorbed by the clearance α between the valve body 32 and the common rail body 20. As a result, it inhibits a problem for the piston sliding hole 43 to deform radially inward. That is, even when the valve body 32 is fastened to the common rail body 20 at a large axial force, it is possible to prevent the sliding clearance between the valve body 32 and the piston 33 from decreasing, not to spoil a slide motion of the piston 33.

Further, the distortion diverting out means 62 and the clearance α between the valve body 32 and the common rail body 20 prevent the sliding hole in the valve body 32 from being deformed radially inward by the fastening at the large axial force, so that it is possible to limit working accuracies of the intimate contact surfaces of the valve body 32 and the stopper 35 for cost decrease.

Eleventh Embodiment

Figure 12:
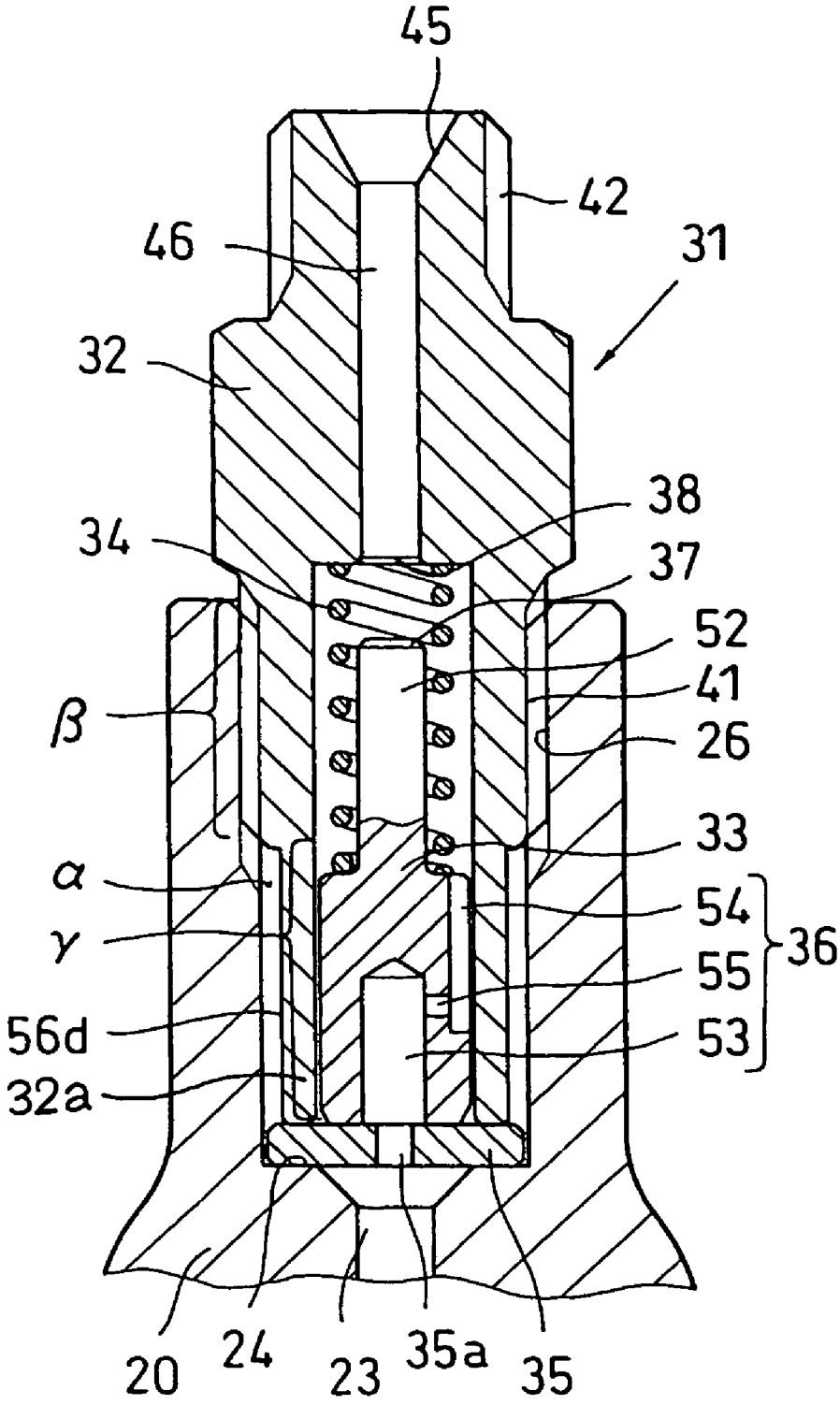
FIG. 12 is a cross-sectional view showing a flow damper according to an eleventh embodiment of the present invention.

An eleventh embodiment is described referring to a cross-sectional view of a flow damper 31 shown in FIG. 12.

In the eleventh embodiment: (1) an axial force applying portion β, which applies an axial force toward a common rail body 20 to a valve body 32 when the valve body 32 is fastened to the common rail body 20, and a direct sliding range γ, in which a piston 33 directly slides on the valve body 32, are provided at a distance from each other in an axial direction; and (2) a clearance α is provided between the direct slide range γ in the valve body 32 and the common rail body 20 (a hole for inserting the valve body 32) to prevent the common rail body 20 from pressing the valve body 32 (a clearance α to absorb a distortion occurring in the hole for inserting the valve body 32).

Specifically, as shown in FIG. 12, (1) a first male screw 41 (axial force applying portion β) is formed on an outer circumference of the valve body 32 in the proximity of a midpoint in the axial direction, and a portion of the valve body 32 below the first male screw 41 (direct sliding range γ) is provided to be inserted in the hole of the common rail body 20, so that and the axial force applying portion b and the direct sliding range γ are provided at a distance from each other in the axial direction, and (2) a clearance (cut portion) 56*d* is provided over an entire outer circumference of the valve body 32 below the first male screw portion 41, so that the a clearance α is provided to prevent the common rail body 20 from pressing the valve body 32. The size of the clearance that can absorb the distortion occurring in the hole for inserting the valve body 32 is acceptable, and the size is determined as appropriate in accordance with manufacturing deviations.

A shape of the hole for inserting the valve body 32 can have a distortion such as a deformation by any cause such as heat applied before an installation of the valve body 32 or an external load.

Therefore, by a configuration as in the eleventh embodiment, even when the valve body 32 is fastened to the common rail body 20 at a large axial force, the distortion occurring in the hole for inserting the valve body 32 is absorbed by the clearance α between the valve body 32 and the common rail body 20. Thus, it is possible to inhibit a problem for the distortion occurring in the hole for inserting the valve body 32 to be transmitted to the valve body 32. Accordingly, it is possible to avoid a problem of a distortion of the piston sliding hole 43 so as not to spoil a slide motion of the piston 33.

Twelfth Embodiment

Figure 13:
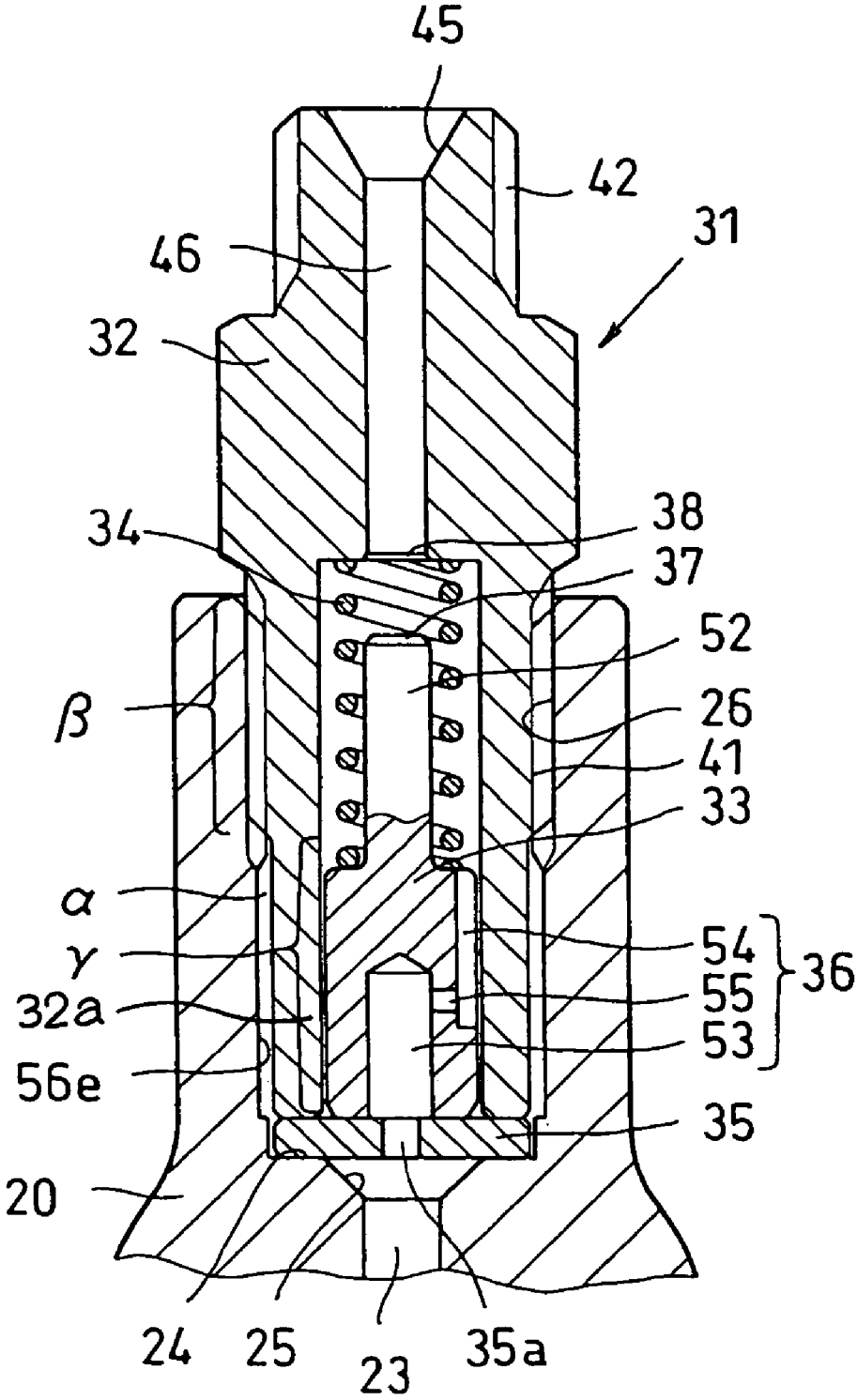
FIG. 13 is a cross-sectional view showing a flow damper according to a twelfth embodiment of the present invention.

A twelfth embodiment is described referring to a cross-sectional view of a flow damper 31 shown in FIG. 13.

In the twelfth embodiment, a clearance (cut portion) 56*e* is provided to extend over an inner circumference of the hole of the common rail body 20 for inserting a lower portion of the first female screw 26, so that the clearance α is provided between a portion of a valve body 32 below the first male screw 41 (the direct sliding range γ in the valve body 32) and the common rail body 20 to prevent toe common rail body 20 from pressing the valve body 32.

Thirteenth embodiment

Figure 14:
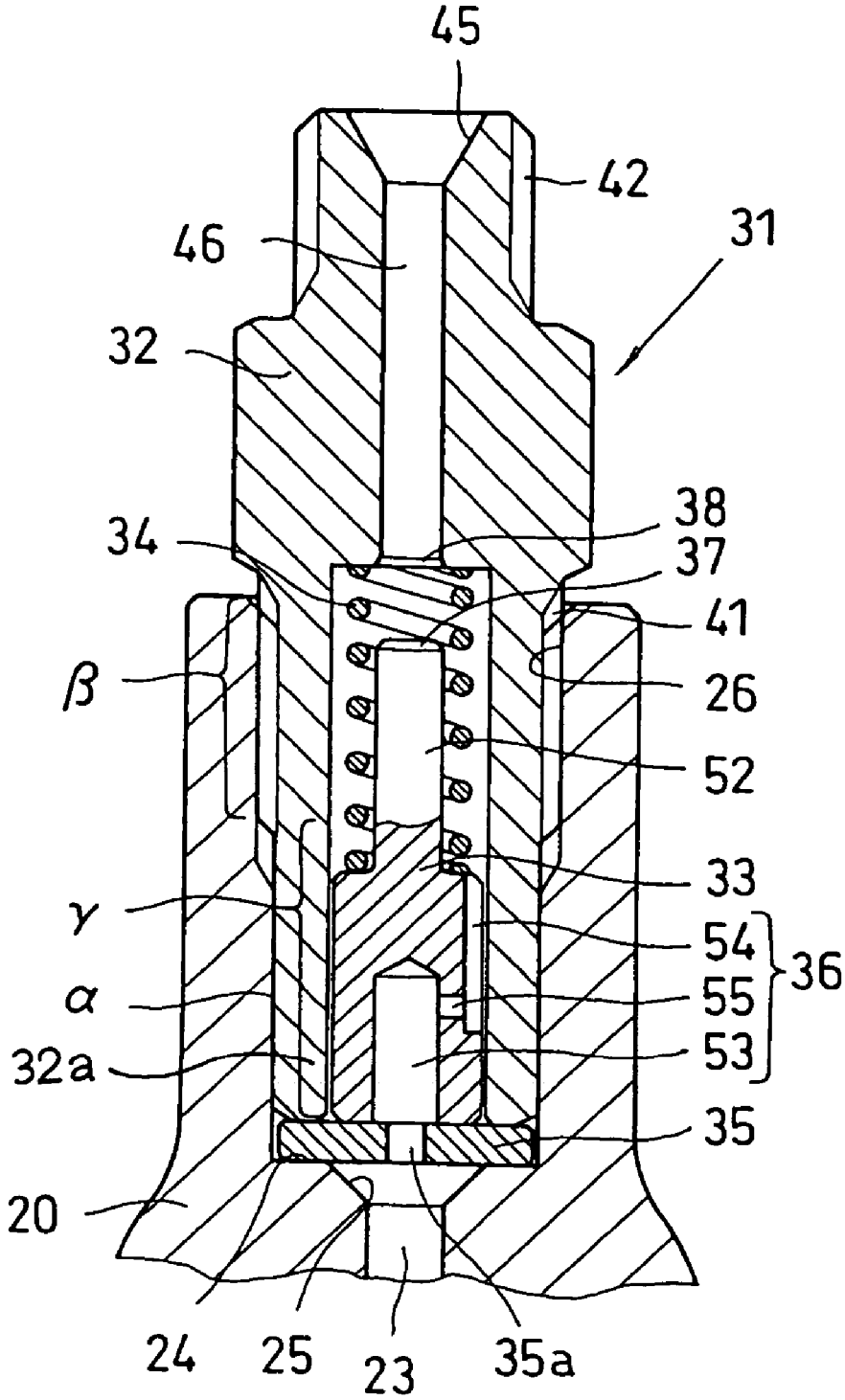
FIG. 14 is a cross-sectional view showing a flow damper according to a thirteenth embodiment of the present invention.

A thirteenth embodiment is described referring to a cross-sectional view of a flow damper 31 shown in FIG. 14.

In the above-described eleventh and twelfth embodiments are shown examples in which the clearance α is extended by providing at least one of the valve body 32 and the common rail body 20 with the clearance (cut portion) 56*d*, 56*e*.

Correspondingly, in the thirteenth embodiment, instead of providing the valve body 32 or the common rail body 20 with the clearance (cut portion) 56*d*, 56*e*, a diameter of the hole for inserting the portion of the valve body 32 below the first male screw 41 (the direct sliding range γ of the valve body 32) is extended, and an outer diameter of the portion of the valve body 32 below the first male screw 41 (the direct sliding range γ of the valve body 32) is narrowed, so that it is intended to increase an insertion clearance for the valve body 32, and the insertion clearance is used as the clearance α to prevent the common rail body 20 from pressing the valve body 32.

Fourteenth embodiment

Figure 15:
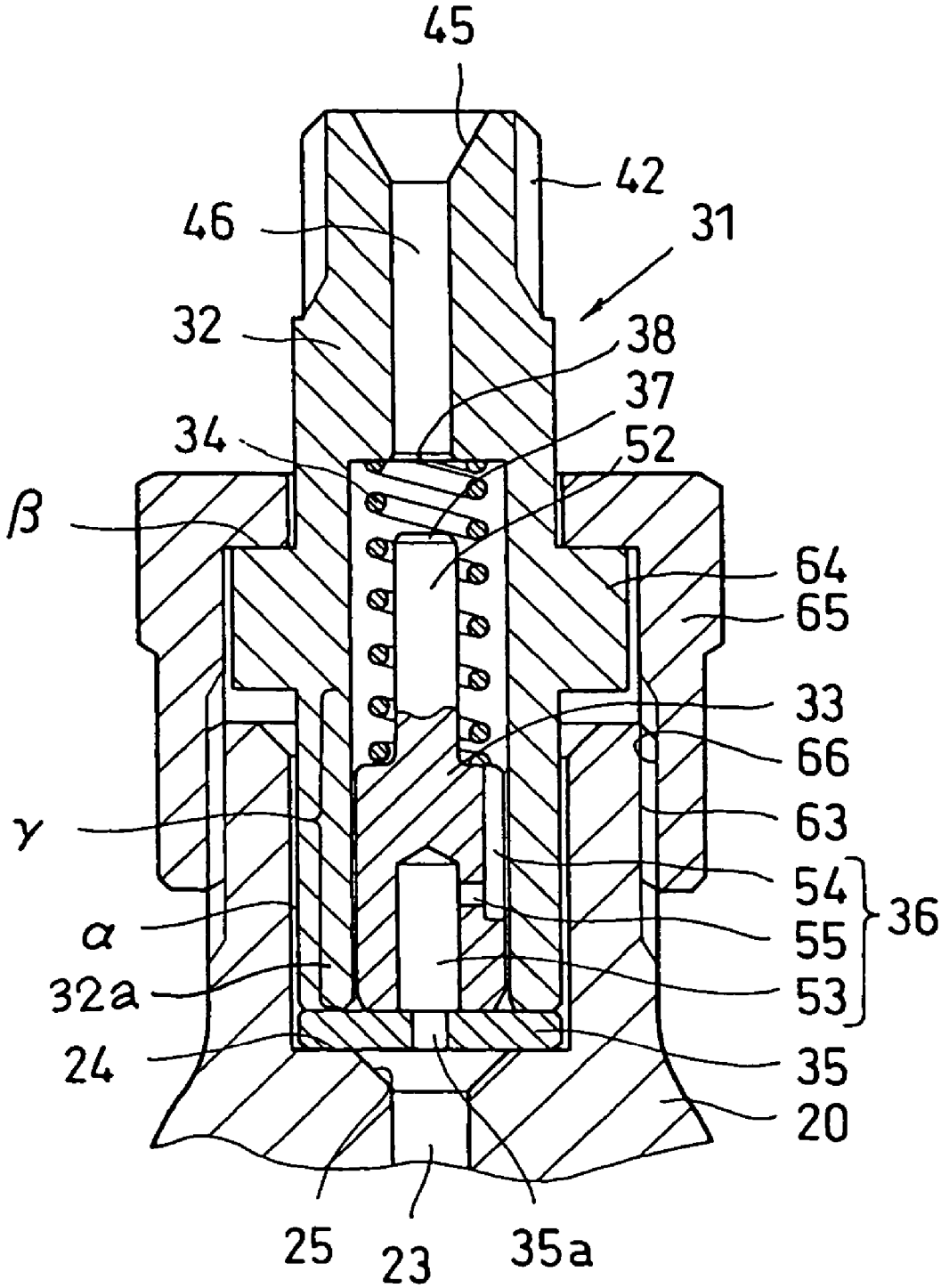
FIG. 15 is a cross-sectional view showing a flow damper according to a fourteenth embodiment of the present invention.
Figure 16:
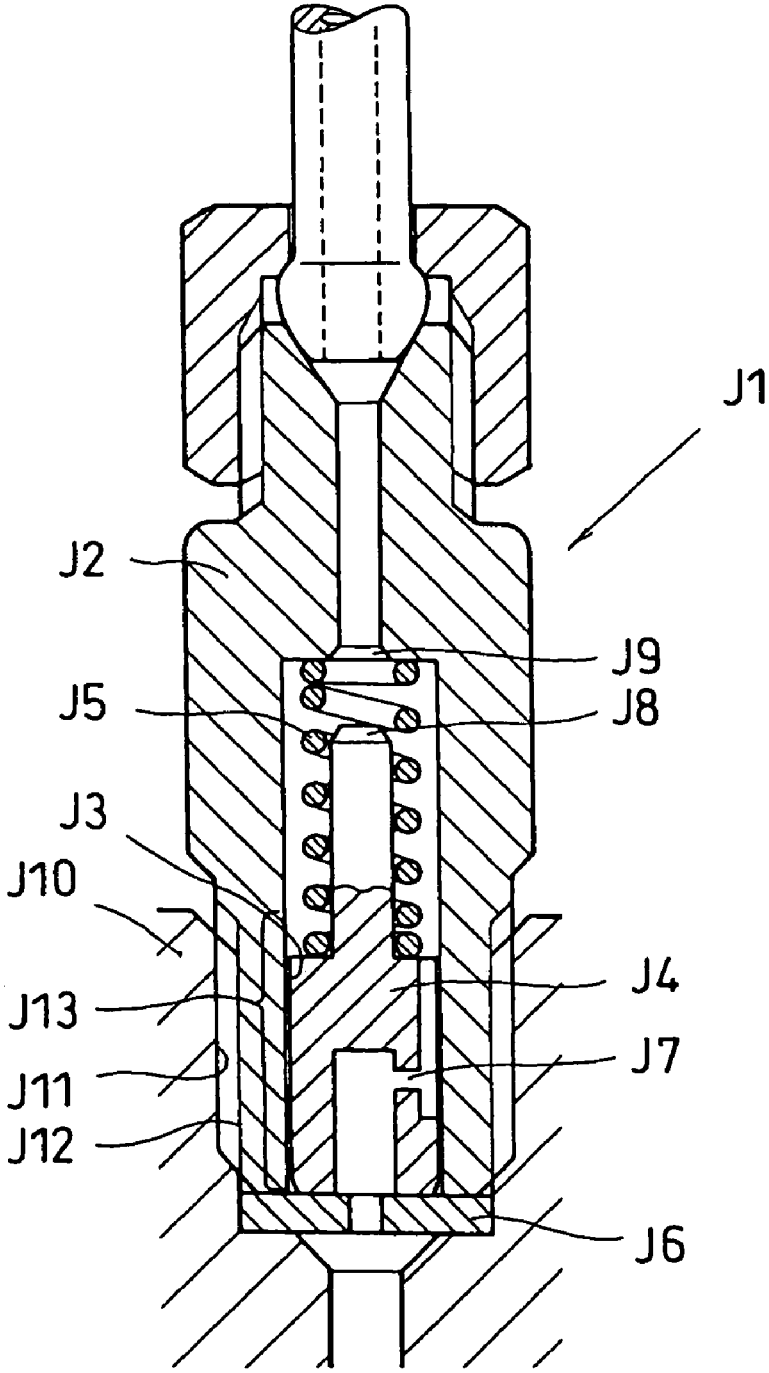
FIG. 16 PRIOR ART
FIG. 16 is a cross-sectional view showing a conventional flow damper.

A fourteenth embodiment is described referring to a cross-sectional view of a flow damper 31 shown in FIG. 15.

In the fourteenth embodiment, (1) a male screw 63 is formed on an outer circumference of the cylindrical portion of the common rail body 20, in which the hole for inserting the valve body 32 is formed, and (2) a female screw 66 of a nut 65, which is associated with a flange 64 provided on the outer circumference of the valve body in the proximity of a midpoint in the axial direction, is tightly screw-fastened to the above-described male screw 63, so that the lower end of the cylindrical wall 32*a* of the valve body 32 is strongly pressed on the first flat surface 24 pf the common rail body 20. That is, the association portion between the flange 64 and the nut 65 serves as the axial force applying portion β. By this construction, the axial force applying portion β and the direct sliding range γ are provided at a distance from each other in the axial direction.

In the fourteenth embodiment, as in the above-described thirteenth embodiment, the diameter of the hole for inserting the valve body 32 is extended, and the outer diameter of the portion of the valve body 32 below the flange 64 is slightly narrowed, so that it is intended to increase the insertion clearance for the valve body 32, and the insertion clearance is used as the clearance α to prevent the common rail body 20 from pressing the valve body 32.

This description of the invention is merely exemplary in nature and, thus, variations that do not depart from the gist of the invention are intended to be within the scope of the invention. Such variations are not to be regarded as a departure from the spirit and scope of the invention.

What is claimed is:

1. A flow damper comprising:

a valve body to be fastened to a port of a common rail body of a common rail fuel injection apparatus, the valve body having an approximately cylinder-shaped piston hole in one end portion thereof so that the piston hole is coaxially aligned to the valve body to open to the port and to provide a cylindrical wall between an outer circumference of the valve body and an inner circumference of the piston hole;

a piston that slides in the piston hole to start or block a fuel flow through the valve body; and a piston operation securing means that secures a slide motion of the piston against a force for the common rail body to press the valve body to occur a distortion in the cylindrical wall when the valve body is fastened to the port of the common rail body.

2. The flow damper according to claim 1, wherein the piston operation securing means includes a clearance provided between the cylindrical wall and the piston.

3. The flow damper according to claim 1, wherein the piston operation securing means includes:

an additional member disposed in the piston hole and slidably supporting the piston therein; and a clearance provided between the cylindrical wall and the additional member.

4. The flow damper according to claim 1, wherein the piston operation securing means includes a restriction member press-fitted into a lower end portion of an inner circumference of the cylindrical wall.

5. The flow damper according to claim 1, wherein the piston operation securing means includes:

a distortion diverting out means that diverts the distortion of the cylindrical wall outward in a radial direction of the valve body when the valve body is fastened to the port of the common rail body; and a clearance is provided between the cylindrical wall and the common rail body in the radial direction in a state that the valve body is fastened to the common rail body.

6. The flow damper according to claim 5, wherein the distortion diverting out means includes a leading end of the cylindrical wall that is disposed radially outside of a midpoint in the thickness of the cylindrical wall.

7. The flow damper according to claim 1, wherein the piston operation securing means includes:

an axial force transmission portion that mainly transmits an axial force between a common rail body and a valve body when the valve body is fastened to the port of the common rail body;

a direct sliding range, in which a piston directly slides on an inner circumference of the piston hole of the valve body, being provided at a distance from the axial force transmission portion in an axial direction of the valve body; and a clearance provided between the direct slide range in the valve body and the common rail body.

* * * * *